United States Patent [19]

Schumacher et al.

[11] 4,099,967

[45] Jul. 11, 1978

[54] GALLING RESISTANT AUSTENITIC STAINLESS STEEL

[75] Inventors: William J. Schumacher; Harry Tanczyn, both of Baltimore, Md.

[73] Assignee: Armco Steel Corporation, Middletown, Ohio

[21] Appl. No.: 751,022

[22] Filed: Dec. 14, 1976

[51] Int. Cl.[2] ..... C22C 38/02; C22C 38/58

[52] U.S. Cl. ..... 75/128 A; 75/128 C

[58] Field of Search ..... 75/128 A, 128 C; 148/38

[56] References Cited

U.S. PATENT DOCUMENTS

| | | | |
|---|---|---|---|
| 2,984,563 | 5/1961 | Tanczyn | 75/128 C |
| 3,615,368 | 10/1971 | Baumel | 75/128 C |
| 3,663,215 | 5/1972 | Tanczyn | 75/128 C |
| 3,785,787 | 1/1974 | Yokota et al. | 75/128 C |
| 3,806,337 | 4/1974 | Jones | 75/128 C |
| 3,900,316 | 8/1975 | Jones | 75/128 C |
| 3,912,503 | 10/1975 | Schumacher et al. | 75/128 A |
| 4,002,510 | 1/1977 | Wilde | 75/128 G |

FOREIGN PATENT DOCUMENTS

| | | | |
|---|---|---|---|
| 1,275,007 | 5/1972 | United Kingdom | 75/128 C |

OTHER PUBLICATIONS

Steel Products Manual, 12/1974, pp. 21–22.

*Primary Examiner*—Arthur J. Steiner
*Attorney, Agent, or Firm*—Melville, Strasser, Foster & Hoffman

[57] ABSTRACT

An austenitic stainless steel which in wrought or cast, and annealed, condition exhibits excellent galling resistance, excellent stress corrosion resistance in chloride-containing environments, good resistance against intergranular corrosion, good high temperature oxidation resistance, and a high work hardening rate. The broad composition range is, in weight percent, about 13 to about 19% chromium, about 13 to about 19% nickel, 0.5 to about 4% manganese, 3.5 to about 7% silicon, up to about 0.15% carbon, less than 0.04% nitrogen, about 0.05% maximum phosphorus, about 0.05% maximum sulfur, and balance essentially iron except for incidental impurities. The steel can be readily worked with conventional equipment and has particular utility for applications in which moving metal-to-metal contact, corrosive attack and/or elevated temperature are encountered in combination. The steel can also be cast into articles of ultimate use, or utilized in powder metallurgy techniques.

2 Claims, No Drawings

GALLING RESISTANT AUSTENITIC STAINLESS STEEL

BACKGROUND OF THE INVENTION (1) Field of the Invention

This invention relates to an austenitic stainless steel exhibiting the combination of excellent galling resistance in conventional wrought and annealed form, excellent stress corrosion resistance in chloride-containing environments, good resistance against intergranular corrosion, good high temperature oxidation resistance, good wear resistance, and a high work hardening rate. The alloy of this invention can be readily worked with conventional equipment into plate, sheet, strip, bar, rod and the like, and retains a substantially austenitic structure throughout a wide temperature range.

The steel of the invention is adapted to applications in which moving metal-to-metal contact, corrosive attack and/or high temperatures are encountered in combination. Although not so limited, the steel has particular utility for fabrication into roller chains, link belts on conveyors, valves subjected to elevated temperature, woven metal belts for continuous heat treating furnaces, fasteners, pins and bushings.

(2) Description of the Prior Art

Although galling and wear may occur under similar conditions, the types of deterioration involved are not similar. Galling may be defined as the development of a condition on a rubbing surface of one or both contacting metal parts wherein excessive friction between minute high spots on the surfaces results in localized welding of the metals at these spots. With continued surface movement this results in the formation of even more weld junctions which eventually sever in one of the base metal surfaces. The result is a build-up of metal on one surface, usually at the end of a deep surface groove. Galling is thus associated primarily with moving metal-to-metal contact and results in sudden catastropic failure by seizure of the metal parts.

On the other hand, wear is synonymous with abrasion and can result from metal-to-metal contact, or metal-to-non-metal contact, e.g. the abrasion of steel mining equipment by rocks and similar mineral deposits. Such wear is characterized by relatively uniform loss of metal from the surface, as contrasted to localized grooving with consequent metal build-up, as a result of rubbing a much harder metallic surface against a softer metallic surface. The distinction between galling and wear can perhaps best be illustrated by the fact that galling can be eliminated by mating or coupling a very hard metallic surface with a much softer metallic surface, whereas wear or abrasion in metal-to-metal contact would be increased by mating a very hard surface with a much softer one.

An article by Harry Tanczyn entitled "Stainless Steel Galling Characteristics Checked" in *STEEL*, Apr. 20, 1954 points out that stainless steel sections at a relatively high hardness level, or with a substantial difference in hardness, exhibit better resistance to galling than the combination of two soft members. This may be explained by the theory that the hardened sections deform elastically near the contact points under loading, while the softer pieces yield plastically for a significant distance beneath the contact points. During movement, the hardened surfaces apparently recover elastically with decrease in pressure, and this motion tends to sever any metallic welding. This article also indicates that good resistance to galling may be traceable to the combination of a suitable oxide surface film and a hard backing. Oxide films were found to influence the galling characteristics of metals, e.g. a film of $Fe_3O_4$ increased the resistance of mild steel to galling, while a film of $Fe_2O_3$ did not benefit resistance to galling.

Among the numerous prior art steels currently available, the austenitic AISI Type 304 is suited to a variety of uses involving welding and fabrication, but the galling and wear resistance of this steel are poor, and the metal is likely to fail when subjected to such conditions.

A precipitation-hardening stainless steel, sold under the registered trademark ARMCO 17-4 PH (about 15.4% chromium, about 4.0% nickel, about 4.0% copper, about 1.0% manganese, about 1.0% silicon, up to 0.07% carbon, 0.35% columbium, and remainder iron), while possessing high strength and hardness in the hardened condition, exhibits only fair galling and wear resistance.

U.S. Pat. No. 3,663,215, issued May 16, 1972 to H. Tanczyn, discloses a steel having improved wear resistance, which at the same time is weldable, workable, and/or machinable, and precipitation hardenable by heat treatment to great hardness. It has been found that this steel has good galling resistance. However, it contains large amounts of expensive alloying elements, and it is difficult to process with standard steel mill equipment. The broad composition ranges are about 10 to about 22% chromium, about 14 to about 25% nickel, about 5 to about 12% silicon, one or more of the elements molybdenum up to about 10%, tungsten up to about 8%, vanadium up to about 5%, columbium up to about 5% and titanium up to about 5%, these additional elements being in sum total of about 3 to about 12%. Carbon is present up to about 0.15% and nitrogen up to about 0.05%. In this alloy silicon is stated to form silicides of molybdenum, tungsten and the like, in finely dispersed form in the matrix of the precipitation-hardened steel. These silicides are of extreme hardness, thereby providing good wear resistance.

A prior art steel presently considered to have the best resistance to wear and galling is the straight chromium AISI Type 440C, containing about 16 to 18% chromium, about 1% maximum manganese, about 1% maximum silicon, about 0.75% maximum molybdenum, about 0.95 to 1.20% carbon, and remainder iron. This steel is hardenable by heat treatment but has poor corrosion resistance and poor formability. It is difficult to roll into plate, strip, sheet, bar or rod, and articles of ultimate use cannot be readily fabricated from plate, sheet, strip, bar or rod form.

U.S. Pat. No. 2,177,454, issued Oct. 24, 1939 to H. L. Frevert et al, discloses a valve steel for use in internal combustion engines, preferably containing from 0.10 to 1.0% carbon, over 10% and less than 20% chromium, 5 to 13% manganese plus nickel, the manganese being over 3% and less than 10.25% and nickel being over 1.75% and not over 3.5%, with the manganese content substantially exceeding the nickel content, 2.5 to 4.5% silicon or aluminum, the silicon being over 1.25%, and balance substantially iron.

U.S. Pat. No. 3,615,368, issued Oct. 26, 1971 to A. Baumel, discloses an austenitic steel alleged to have high resistance to stress crack corrosion and to solutions of nitric acid, containing up to 0.25% carbon, 1.5 to 10% silicon, up to 10% manganese, 13 to 30% chromium, 4 to 30% nickel, up to 10% molybdenum, 0.04 to 0.3% nitrogen, and balance iron and unavoidable impurities. The addition of nitrogen in an amount of 0.04 to 0.3%, and preferably from 0.08 to 0.2%, is stated to minimize formation of intermetallic deposits at the grain boundaries of the heat affected zone of a weld.

Reference is further made to U.S. Pat. No. 3,912,503 issued Oct. 14, 1975 to the present applicants and assigned to the assignee of the present application. The patent discloses an austenitic stainless steel having excellent galling resistance in conventional wrought form, good wear resistance, good corrosion resistance in chloride-containing environments, and a high work hardening rate. The steel of this U.S. patent consists essentially of from about 10 to about 25% (preferably about 12 to about 19%) chromium, about 3% to about 15% (preferably about 4 to about 12%) nickel, about 6 to about 16% (preferably about 7 to about 13%) manganese, about 2 to about 7% (preferably 3 to 5%) silicon, about 0.001 to about 0.25% (preferably about 0.01 to about 0.12%) carbon, about 0.001 to about 0.4% (preferably about 0.03 to about 0.3%) nitrogen, up to about 4% (preferably about 0.75% maximum) molybdenum, up to about 4% (preferably about 0.75% maximum) copper, a maximum of about 0.09% phosphorus, a maximum of 0.25% sulfur, a maximum of 0.50% selenium, and remainder essentially iron except for incidental impurities.

In our above-mentioned U.S. Pat. No. 3,912,503 the silicon addition is believed to modify the composition of the surface oxide film of the steel, making it more stable and adherent. Silicon is dissolved in an austenitic matrix. Moreover, the silicon addition exerts a substantial increase in the work hardening rate of the steel. Unlike the steel of the above mentioned U.S. Pat. No. 3,663,215, silicon does not form a silicide of molybdenum, tungsten, vanadium, columbium and/or titanium.

SUMMARY

It is the object of the present invention to provide an austenitic stainless steel having, in combination, excellent galling resistance in wrought or cast form, excellent stress corrosion resistance in chloride-containing environments, excellent resistance against intergranular corrosion, good high temperature oxidation resistance, good wear resistance and a high work hardening rate, which is at the same time readily workable into plate, sheet, strip bar, rod, tube, pipe, and like wrought products. The steel is also adapted to powder metallurgy applications, and surface coatings including those made by powder-filled tube forms and the plasma arc process.

In its broad ranges the steel of the present invention consists essentially of, in weight percent, about 13 to about 19% chromium, about 13 to about 19% nickel, 0.5 to about 4% manganese, 3.5 to about 7% silicon, up to about 0.15% carbon, less than 0.04% nitrogen, about 0.05% maximum phosphorus, about 0.05% maximum sulfur, and balance iron except for incidental impurities. More specifically, impurities such as molybdenum, copper, tungsten, columbium, vanadium and titanium are restricted to residual amounts.

The elements silicon, chromium, nickel, manganese and nitrogen, and the balance therebetween are critical in every sense. Omission of one of the essential elements, or departure from the ranges set forth above, results in loss of one or more of the desired properties.

The silicon content of the steel of the present invention is of particular criticality. Although not bound by theory, it is believed that silicon (within the range of 3.5 to 7%, and preferably from 4 to 5.5%), performs the same dual function in the present steel as explained above with respect to the steel of our U.S. Pat. No. 3,912,503. More specifically, the effect of silicon in conferring galling resistance and internal strain-or work-hardening is dependent on the silicon being dissolved in an austenitic matrix. This effect is not obtained in a ferritic phase.

A minimum of 3.5% and preferably about 4.0% silicon is needed for this effect. A maximum of 7% silicon and preferably a maximum of about 5.5%, must be observed for good workability and formability, and also to assure an austenitic structure.

At least 13% chromium is required for corrosion resistance and high temperature oxidation resistance. However, a maximum of 19% chromium must be observed in order to insure an austenitic structure at minimum nickel levels. Chromium has little influence on the strain hardening rate.

Nickel is necessary in the amount of at least 13% in order to obtain an austenitic structure. Since silicon is a potent ferrite former, at least about 13% nickel is needed to offset this effect. However, a maximum of about 19% nickel must be observed since greater amounts adversely affect galling resistance and decrease the strain or work hardening rate.

A minimum of 0.5% manganese is needed to stabilize the austenitic structure and to provide a high strain hardening rate. More than 4% manganese provides no additional benefit in achieving these functions.

Nitrogen must be restricted to less than 0.04% by weight for best galling resistance and resistance against intergranular corrosion (i.e. low Huey rate) in the reheated condition, as will be shown hereinafter. The relatively high silicon range of the steel of the present invention greatly restricts nitrogen solubility. A purposeful addition of nitrogen thus would result in the danger of porosity, i.e. gassy heats, in the as-cast steel.

Contrary to the steel of the above mentioned U.S. Pat. No. 3,663,215, silicides of molybdenum, tungsten, vanadium, columbium and/or titanium are not relied upon to impart wear resistance. Surprisingly, elimination of these elements from the steel of the present invention (i.e. restriction to residual amounts) results in a marked improvement in galling resistance, the theoretical basis for which has been explained hereinabove. Moreover, omission of molybdenum, tungsten, vanadium and the like results in an improvement in the hot and cold workability of the steel of this invention on conventional mill equipment. Since these elements are ferrite formers, introduction thereof would require additional nickel with consequent higher cost.

DESCRIPTION OF THE PREFERRED EMBODIMENTS

While the broad composition set forth above exhibits the novel combination of properties which is the primary object of the invention, optimum stress corrosion resistance in chloridecontaining environments is achieved by observance of the following preferred ranges, all percentages being by weight:

| | |
|---|---|
| Chromium | about 14% to about 16% |
| Nickel | about 14% to about 17% |
| Manganese | about 0.5% to about 3.0% |
| Silicon | about 4.0% to about 5.5% |
| Carbon | about 0.03% to about 0.10% |
| Nitrogen | about 0.03% maximum |
| Phosphorus | about 0.05% maximum |
| Sulfur | about 0.05% maximum |
| Iron | balance, except for incidental |

-continued

| |
|---|
| impurities. |

As in the broad composition, the preferred composition also restricts the elements molybdenum, copper, tungsten, columbium, vanadium and titanium to residual amounts.

The elements silicon and manganese act to lower the stacking fault energy at the planes of atom disarray within the annealed austenitic matrix of the steel of the invention. Under mechanical loading, the lowered stacking fault energy promotes the development of numerous stacking faults in the face-centered cubic annealed austenitic microstructure. When a stacking fault forms, it is equivalent to producing locally several layers of a hexagonal close-packed structure. The strain-hardening rates of faulted structures are much greater than those of unfaulted structures, i.e., a multiplication factor is introduced. In addition, the frictional forces at surface contact points for hexagonal close-packed structures are markedly lower than those for face-centered cubic structures. Moreover, in the present steel silicon atoms diffuse rapidly to points or planes of stress (viz., contact surfaces), thereby achieving excellent galling resistance.

The function of silicon in increasing the work hardening or strain-aging rate of the steel of the invention is somewhat offset by the nickel addition, since an increase in the nickel content tends to lower slightly the work hardening rate of the steel by increasing the stacking fault energy. However, an increase in the silicon content within the range set forth above results in a net increase in the work hardening rate. Preferably nickel is varied directly in proportion to the silicon content in order to offset the ferrite forming tendencies of silicon, without unduly lowering the work hardening rate of the steel.

Carbon is of course present and a maximum of 0.15% should be observed since silicon directly limits carbon solubility in ferrous-base alloys. Precipitation of carbon as carbides tends to produce a ferro-magnetic condition, which should be avoided in the steel of the invention. Preferably, a minimum of about 0.03% carbon is present for its function in strengthening the steel and in contributing to an austenitic structure. For best stress corrosion resistance the carbon preferably is restricted to a maximum of about 0.10%.

EXAMPLE 1

An experimental heat has been prepared falling within the above preferred composition ranges and subjected to stress corrosion resistance, high temperature oxidation resistance and galling resistance tests. The heat was melted, cast in conventional manner, hot forged to ¾ inch round corner squares, annealed at 1093° C for ½ hour and water quenched. This heat (hereinafter designated as Example 1) had the following composition in weight percent:

| | |
|---|---|
| Chromium | 15.27% |
| Nickel | 15.69% |
| Manganese | 0.80% |
| Silicon | 4.76% |
| Carbon | 0.063% |
| Nitrogen | 0.03% |
| Phosphorus | residual |
| Sulfur | residual |
| Iron | balance, except for incidental |

-continued

| |
|---|
| impurities. |

Stress corrosion tests on specimens of the above heat and comparative tests on a specimen of AISI Type 304 (0.08% max. carbon, 2.00% max. manganese, 18.00 - 20.00% chromium, 8.00 - 12.00% nickel) were conducted in boiling magnesium chloride solution of 42% concentration at varying tensile stresses and are set forth in Table I. It is apparent that the steel of the present invention is far superior in stress corrosion resistance in chloride-containing environments to Type 304, despite the unexplained premature failure of the specimen of Example 1 at 45 ksi. The results at stresses of 50 and 60 ksi indicate that the test at 45 ksi should not be considered typical.

TABLE I

| | Stress Corrosion Resistance Boiling $MgCl_2$ (42%) Hours to Failure | | |
|---|---|---|---|
| Stress (ksi) | Example 1 (Steel of Invention) | | Type 304 |
| 40 | 285.6 | | 0.9 |
| 45 | 40.7 | | 0.8 |
| 50 | 99.2 | (average of 2 tests) | 0.6 |
| 60 | 110.1 | | 0.4 |

Static and cyclic high temperature oxidation tests were conducted on the steel of Example 1 in comparison with specimens of AISI Type 304 and AISI Type 310. These tests are reported in Table II. The cyclic test results are considered more significant than the static test results, and it is evident that the steel of the invention exhibits far greater oxidation resistance than Type 304 and is comparable in oxidation resistance to the highly alloyed Type 310 (0.25% max. carbon, 2.00% max. manganese, 24.00 - 26.00% chromium, 19.00 - 22.00% nickel). In this connection, it should be noted that Type 310 is generally recommended for applications requiring good high temperature strength and oxidation resistance.

TABLE II

| | Oxidation Resistance Weight loss ($mg/cm^2$) | | |
|---|---|---|---|
| | Example 1 (Steel of Invention) | Type 304 | Type 310 |
| Static | | | |
| 240 hrs. at 1093° C | 158 | 2265 | 21 |
| Cyclic | | | |
| 1288°-871° C/Rm.T. 27 cycles | 10 | 1064 | 21 |
| 1065°-830° C/Rm.T 55 cycles | 14 | 361 | 10 |

The annealed bar stock of Example 1 was subjected to galling resistance tests against itself and against a number of prior art alloys. For purposes of comparison each of four of the prior art alloys was tested against itself, and AISI Type 304 was tested against the same prior art alloys as Example 1. Test results are set forth in Table III.

The test method utilized in obtaining the data of Table III comprised rotation of a polished cylindrical section or button for one revolution under pressure against a polished block surface in a standard Brinell hardness machine. A button specimen was prepared by drilling a countersunk hole to accommodate most of the exposed Brinell hardness ball, the specimen then being mounted in Bakelite and polished to a 600 grit finish in a Buehler Automet Unit to obtain a relatively flat test surface, with the edges slightly rounded. The button was then broken out of the Bakelite, and the edges were hand deburred. A block specimen was ground parallel on two sides and hand-polished to a 3/0 emery grit finish, equivalent to a 600 grit finish. Both the button and block specimens were degreased by wetting with acetone, and the hardness ball was lubricated just prior to testing. The button was hand-rotated slowly at a predetermined load for one revolution and examined for galling at 10× magnification. If galling was not observed (i.e. absence of metal build-up, usually at the end of a groove), a new button and block area couple was tested at sucessively higher loads until galling was first observed. Confirmation was obtained by testing one more coupling or combination at a higher load. Since light loads did not cause full area contact due to the rounded button edges, the actual contact area was measured at 10× to convert to galling stress.

In Table III the button specimen is the first alloy mentioned in each couple, and the second alloy is the block specimen. It will be noted that several couples of Example 1 with prior art alloys reached the limits of the test equipment without exhibiting galling so that the true galling stress of these samples was not actually determined.

It is apparent from the data of Table III that the steel of the present invention exhibits excellent galling resistance when rotated against itself, and without exception exhibits substantially higher galling resistance than AISI Type 304 when rotated against the same prior art alloy. It is significant to note that AISI Type 440C, presently considered to have the best resistance to galling and wear, exhibited a galling stress of 11 ksi when rotated against itself, and hence is substantially inferior in galling resistance to the steel of the present invention when rotated against itself.

Hardness values for the various alloys subjected to galling resistance tests were not determined, but it was observed empirically that the initially hardness of the steel of Example 1 was substantially less than that of Type 440C. Despite the high hardness of Type 440C, its galling resistance against itself and against AISI Type 304 was substantially lower than that of the steel of the invention.

TABLE III

| Couple | Galling Resistance Unlubricated Tests Galling Stress (ksi) |
|---|---|
| Example 1 v. Example 1 | 40+ |
| AISI 304 v. AISI 304 | 3 |
| AISI 316 v. AISI 316 | 4 |
| AISI 410 v. AISI 410 | 3 |
| AISI 440C v. AISI 440C | 11 |
| Example 1 v. AISI 316 | 12 |
| AISI 304 v. AISI 316 | 2 |

TABLE III-continued

| Couple | Galling Resistance Unlubricated Tests Galling Stress (ksi) |
|---|---|
| Example 1 v. AISI 410 | 20 |
| AISI 304 v. AISI 410 | 2 |
| Example 1 v. AISI 303 | 18 |
| AISI 304 v. AISI 303 | 2 |
| Example 1 v. AISI 304N | 37.7+ |
| AISI 304 v. AISI 304N | 2 |
| Example 1 v. AISI 201 | 39.2+ |
| AISI 304 v. AISI 201 | 2 |
| Example 1 v. AISI 440C | 55.6+ |
| AISI 304 v. AISI 440C | 3 |

+ = Reached practicable load limit of test machine without galling

Further galling resistance tests were conducted on several experimental alloys somewhat similar in composition to the steel of the invention but departing therefrom in one or more of the essential elements. The compositions of these alloys, and galling resistance of each rotated against itself by the above described test method are set forth in Table IV.

A comparison of Sample 2 with Sample 3 (3.3% and 4.2% silicon, respectively) indicates that a minimum of about 3.5% silicon is necessary for excellent galling resistance.

A comparison of Samples 4 and 5 with Sample 3 indicates that when chromium and nickel each exceed 19%, galling resistance is drastically decreased, regardless of silicon contents.

Sample 6 is within the broad ranges of the steel of the invention except for the nitrogen content. It is apparent that the nitrogen level of 0.05% adversely affected the galling resistance.

Accordingly, the silicon, chromium, nickel and nitrogen ranges of the steel of the present invention must be considered critical from the standpoint of galling resistance. The presence of tungsten in Samples 4 and 5 apparently also contributed to the poor galling resistance, although tungsten is substantially neutral with respect to austenite stability when the alloy undergoes work-hardening.

TABLE IV

| Sample | COMPOSITIONS-WEIGHT PERCENT C | Mn | Si | Cr | Ni | N | W | Galling Stress (ksi) v. itself |
|---|---|---|---|---|---|---|---|---|
| 2 | .078 | 8.0 | 3.3 | 16.2 | 5.0 | .03 | nil | 27 |
| 3* | .070 | 7.8 | 4.2 | 16.0 | 6.0 | .04 | nil | 42+ |
| 4 | .04 | 0.5 | 3.37 | 20.0 | 20.0 | .04 | 3.5 | 3 |
| 5 | .04 | 0.5 | 4.2 | 20.0 | 20.0 | .04 | 3.5 | 3 |
| 6 | .031 | 0.73 | 5.54 | 15.11 | 15.46 | .05 | nil | 25 |

+ = Reached limit of test machine without galling
* = Steel of preferred composition of applicant' Pat. No. 3,912,503
In the above Samples 2-6, the balance was iron and incidental impurities.

It is therefore evident from the above data that this invention provides an austenitic stainless steel having excellent galling resistance, excellent stress corrosion resistance in chloride-containing environments and good high temperature oxidation resistance.

With respect to intergranular corrosion resistance, particularly at elevated temperature, it has been found that restriction of the nitrogen content to less than 0.04% is critical. Although the previously mentioned Baumel U.S. Pat. No. 3,615,368 alleges that a purposeful nitrogen addition within the range of 0.04 to 0.3% and preferably from 0.08 to 0.2%, retards "the formation of intermetallic deposits at the grain boundaries in steels of this type at temperatures of about 850° C," and reduces or avoids "increased corrosion adjacent to the seam weld", applicants have conducted tests which prove that in fact the nitrogen addition which is the novel feature of the Baumel patent actually increases the extent of intergranular precipitates even with as little as a 5-minute reheating period at about 850° C. These increased grain boundary precipitates result in low ductility, lower notch-impact toughness, susceptibility to cracking during welding and during annealing of prior cold worked products, as well as a decrease in galling resistance as shown above in Sample 5 of Table IV. Of still greater significance, the increase in the extent of grain boundary precipitates resulting from a nitrogen addition of 0.04% or more decreases resistance to intergranular corrosion after exposure to elevated temperature (particularly about 850° C.)

Two heats were prepared and subjected to comparative testing. The compositions of these heats are set forth in Table V, and heat treatments and corrosion test results are set forth in Table VI.

TABLE V

| | COMPOSITION-WEIGHT PERCENT | | | | | |
|---|---|---|---|---|---|---|
| Sample | C | Mn | Si | Cr | Ni | N |
| 7 | .032 | .70 | 3.7 | 18.9 | 15.55 | .033 |
| 8 | .033 | .78 | 3.9 | 18.5 | 15.29 | .15 |

In Samples 7 and 8, phosphorus was 0.008%, sulfur not greater than 0.025%, and balance iron.

Bar stock from Samples 7 and 8 was annealed by water quenching from 1100° C (after 30 minutes), and individual annealed specimens, ⅝ inch round by ⅝ inch long, were reheated at 850° C for periods of time set forth in Table VI. These specimens were then subjected to the Huey Test-ASTM A-262 Practice C, and to the Nitric-Hydrofluoric Acids Test-ASTM A-262-68 Practice D. The values of Table VI were averages of duplicate tests. The Huey rates were measured in inches per month, and the $HNO_3$-HF rates in percent weight loss.

It is evident that the Huey rates and $HNO_3$-HF rates of Sample 7 (0.033% nitrogen), a steel of the present invention, are good even after reheating for 4 hours, whereas those of Sample 8, which differed substantially only in the nitrogen content of 0.15%, were unacceptably high. Metallographic examination of etched heat treated specimens (at 500X magnification) confirmed that Sample 7 exhibited thin, discontinuous intergranular precipitates while Sample 8 exhibited thick, continuous grain boundary precipitates. This accounts for the marked differences in intergranular corrosion resistance, and also indicates that the steel of the invention possesses excellent welding characteristics.

TABLE VI

| | INTERGRANULAR CORROSION RESISTANCE | | |
|---|---|---|---|
| | Heat Treatment | Huey Test ASTM A-262 Practice C* | $HNO_3$-HF TEST ASTM A-262 Practice D** Wt. percent |
| Sample 7 | Annealed 1100° C-1/2hr.-W.Q. | .0022 | .630 |
| Sample 7 | Annealed and reheated 850° C 1 minute-W.Q. | .0041 | .563 |
| Sample 7 | Annealed and reheated 850° C 5 minute-W.Q. | .0040 | .372 |
| Sample 7 | Annealed and reheated 850° C 30 minute-W.Q. | .0045 | .476 |
| Sample 7 | Annealed and reheated 850 20 C 2 hour-W.Q. | .0047 | .368 |
| Sample 7 | Annealed and reheated 850° C 4 hour-W.Q. | .0047 | .396 |
| Sample 8 | Annealed 1100° C-1/2hr.-W.Q. | .0026 | .693 |
| Sample 8 | Annealed and reheated 850° C 1 minute-W.Q. | .0130 | 4.62 |
| Sample 8 | Annealed and reheated 850° C 5 minute-W.Q. | .0115 | 3.89 |
| Sample 8 | Annealed and reheated 850° C 30 minute-W.Q. | .0143 | 3.08 |
| Sample 8 | Annealed and reheated 850° C 2 hour-W.Q. | .0118 | 1.88 |
| Sample 8 | Annealed and reheated 850° C 4 hour-W.Q. | .0148 | 2.25 |

*Average of two 48-hour periods.
**One 2-Hour period.

In the annealed condition, wrought products of the steel of the invention are sufficiently ductile to permit ready fabrication into chains, valves, woven metal belts, fasteners of various types and other articles of ultimate use where metal-to-metal contact under stress would be encountered either at ambient or elevated temperatures. The steel of the invention can readily be welded or brazed and may be cut, drilled, tapped, threaded and machined in other manner in the fabrication of articles of ultimate use.

The steel of the invention may be melted in any conventional manner, for example in an induction furnace, and may then be cast into ingots or continuously cast, hot reduced in standard mill equipment to strip, sheet, bar or rod form, annealed, and if desired, cold reduced. Annealing of the hot reduced and/or cold reduced material at about 980° to 1095° C for ½ hour restores sufficient ductility to permit further fabrication.

Alternatively, the molten steel may be cast into articles of ultimate use, the only limitation being that such articles have a size or mass which will permit annealing thereof in conventional equipment.

The steel may also be comminuted into particulate form suitable for powder metallurgy processing into compacted, pressed and/or sintered products, by techniques such as atomizing a melt.

Steel having the broad composition of the invention has utility in welding, overlay of metallic surfaces, and like applications. For such uses the steel may be produced in the form of wire or sheet, or in the form of powder-filled tube-like articles. In the case of filled tube articles part of the alloying elements may be contained in the tube-like covering rather than in the powdered metal, and the compositions and proportions will be so selected that upon melting, as in a welding or overlay operation, a composition will be obtained which is within the broad limits of the invention and which, upon solidification, will be substantially fully austenitic. As a weld filler material the steel may be used to join stainless steels of different or similar compositions.

Plate, sheet, strip, bar, rod, tube, pipe, and like wrought products, metal powder and powder filled tube forms, as well as wrought or cast articles of ultimate use, having the preferred compositions of the present invention, exhibit in the annealed condition a galling resistance of at least 40 ksi stress when rotated against itself in the test method set forth above, a stress corrosion resistance of greater than about 90 hours to failure at 50-60 ksi stress in boiling $MgCl_2$ (42% concentration) determined by the above test method, and a weight loss not exceeding about 20 mg/cm$^2$ by the cyclic oxidation resistance test method set forth above. Moreover, steel of the broad and preferred compositions of the invention, in the annealed condition, exhibits a loss of not greater than 0.005 inches per month after reheating at 850° C for periods of time up to 4 hours, by the Huey Test. Regardless of any accepted standards which may exist, no prior art alloy meets all the above test values, to the best of applicants' knowledge.

While certain preferred embodiments of the invention have been specifically disclosed and described, it should be understood that the invention is not so limited, since many variation will be apparent to those skilled in the art, and the invention is to be given its broadest interpretation within the terms of the following claims.

The embodiments of the invention in which an exclusive property or privilege is claimed are defined as follows:

1. Austenitic stainless steel having a galling resistance of at least 40 ksi stress when rotated against itself by the test described herein, a stress corrosion resistance of greater than 90 hours to failure at 50–60 ksi stress in boiling magnesium chloride (42% concentration), a Huey rate of not greater than 0.005 inches per month after reheating at 850° C for a time up to four hours, and good high temperature oxidation resistance, consisting essentially of, by weight percent, about 14 to about 16% chromium, about 14 to about 17% nickel, 0.5 to about 3.0% manganese, about 4.0 to about 5.5% silicon, about 0.03 to about 0.10% carbon, about 0.03% maximum nitrogen, about 0.05% maximum phosphorus, about 0.05% maximum sulfur, and balance iron except for incidential impurities.

2. Austenitic stainless steel having a galling resistance of at least 40 ksi stress when rotated against itself by the test described herein, a stress corrosion resistance of greater than 90 hours to failure at 50–60 ksi stress in boiling magnesium chloride (42% concentration), a Huey rate of not greater than 0.005 inch per month after reheating at 850° C for a time up to 4 hours, and good high temperature oxidation resistance, consisting essentially of, by weight percent, about 15.27% chromium, about 15.69% nickel, about 0.80% manganese, about 4.76% silicon, about 0.063% carbon, about 0.03% nitrogen, residual phosphorus and sulfur, and balance iron except for incidental impurities.

* * * * *